US005562974A

United States Patent [19]

Kuroyama et al.

[11] Patent Number: 5,562,974

[45] Date of Patent: Oct. 8, 1996

[54] PERMANENT PAPER

[75] Inventors: Yoshihiro Kuroyama; Yoshiyuki Inoue, both of Tokyo; Susumu Ishikawa, Tokushima-ken; Yoshifumi Iimori, Tokyo, all of Japan

[73] Assignee: Nippon Paper Industries Co., Ltd., Tokyo, Japan

[21] Appl. No.: 87,159

[22] Filed: Jul. 7, 1993

[30] Foreign Application Priority Data

Jul. 8, 1992 [JP] Japan ..... 4-181195

[51] Int. Cl.[6] ..... B32B 3/00

[52] U.S. Cl. ..... 428/211; 428/195; 428/498; 428/537.5; 428/537.7

[58] Field of Search ..... 428/335, 414, 428/513, 530, 195, 211, 498, 537.5, 537.7; 430/448, 495, 498; 162/158, 168.1

[56] References Cited

U.S. PATENT DOCUMENTS

| | | | |
|---|---|---|---|
| 5,013,775 | 5/1991 | Oikawa et al. . | |
| 5,062,922 | 11/1991 | Nakajima et al. | 162/158 |
| 5,177,053 | 1/1993 | Nagura et al. | 503/227 |
| 5,182,161 | 1/1993 | Noda et al. | 428/195 |

FOREIGN PATENT DOCUMENTS

| | | |
|---|---|---|
| 0528133 | 2/1993 | European Pat. Off. . |
| 59-159172 | 9/1984 | Japan . |
| 59-162561 | 9/1984 | Japan . |
| 59-162560 | 9/1984 | Japan . |
| 59-191068 | 10/1984 | Japan . |
| 60-99403 | 6/1985 | Japan . |
| 61-67038 | 4/1986 | Japan . |
| 61-63853 | 4/1986 | Japan . |
| 61-047290 | 6/1986 | Japan . |
| 62-6994 | 1/1987 | Japan . |
| 3141367 | 6/1991 | Japan . |
| 3167397 | 7/1991 | Japan . |
| 3162993 | 7/1991 | Japan . |
| 3242654 | 10/1991 | Japan . |

*Primary Examiner*—William A. Krynski

*Attorney, Agent, or Firm*—Roylance, Abrams, Berdo & Goodman

[57] ABSTRACT

A permanent paper is disclosed which employs as a stock pulp slurry containing at least one kind of filler and aluminum sulfate, a hydrophobic modified rosin emulsion sizing agent and a water-soluble alkaline salt, wherein the pH where said filler is dispersed in water to form 10% of a dispersion is 4–8, the pH of said pulp slurry is controlled within 6.5–7.5 and an alkaline salt of an acid having a pKa of 5–14 at a 25° C. aqueous solution is coated onto said paper and the pH of the coated paper extract in cold water is 7.5–9.0.

5 Claims, 3 Drawing Sheets

PERMANENT PAPER

FIELD OF THE INVENTION

The present invention relates to a paper wherein deterioration is successfully avoided.

BACKGROUND OF THE INVENTION

Sizing agents are generally used for providing a water resistant paper which thereby is not subject to record-blotting. In conventional acid papermaking process, paper is treated with a rosin sizing agent, etc. together with aluminum sulfate as a fixer to obtain required sizing degree. Aluminum sulfate is also effective for avoiding the generation of pitch and slime. However, when aluminum sulfate is used, dehydration reaction occurs due to the existence of $SO_4^{2-}$. Thus, paper deterioration problems such as yellowing and decrease in strength of paper are encountered. 1–2% of Aluminum sulfate based on weight of pulp is usually added in the acid papermaking process, when the pH of pulp slurry becomes 4–5. As shown in FIG. 1, since the effect of rosin sizing agent declines rapidly at a pH of 6 or more than 6 when an attempt is made to neutralize pulp slurry for the purpose of avoiding deterioration, paper having excellent anti-deterioration properties can not be manufactured.

On the other hand, there is a so-called neutral papermaking process providing a paper having excellent anti-deterioration properties. Alkyl ketene dimer as a sizing agent, alkenyl succinic anhydride, etc. as a neutral sizing agent, cationic high polymer as a yield activator in addition to calcium carbonate as a filler are used in such a process. In neutral papermaking technology, the pH of a paper extract is approximately 7.9–9.0, but, the pH of a pulp slurry for papermaking and the pH of a paper extract are similarly alkaline, and thus the whole paper layer structure exhibits the same pH level. As compared with conventional acid papermaking methods, there have been many problems with respect to workability due to the generation of pitch and slime or dirt resulting from a neutral sizing agent, etc. and higher costs are incurred.

SUMMARY OF THE INVENTION

As a result of investigations conducted by the inventors with respect to paper and a method for producing paper having excellent workability and permanence properties, the present invention has been accomplished. It was found that favorable results were obtained when a water-soluble alkaline salt was used in a pulp slurry employing aluminum sulfate and a hydrophobic modified rosin emulsion sizing agent in combination and when an alkaline metal salt of an acid having a pKa of 5–14 was coated by a size press, etc.

Accordingly, despite existence of a sizing method using aluminum sulfate, the object of the present invention is to provide a method of manufacturing paper having excellent workability and which does not deteriorate.

The above-mentioned object of the present invention is achieved by providing a paper which employs as a stock pulp slurry containing at least one kind of filler, and aluminum sulfate, a hydrophobic modified rosin emulsion sizing agent and a water-soluble alkaline salt, wherein the pH where the filler is dispersed in water to form 10% of a dispersion is 4–8, the pH of the pulp slurry is controlled within 6.5–7.5 and an alkaline salt of an acid having a pKa of 5–14 at 25° C. aqueous solution is coated onto the paper and the pH of coated paper extract in cold water is 7.5–9.0

The present invention successfully controls the generation of pitch and slime by the addition of aluminum sulfate to a papermaking pulp slurry. Further, paper machine dirt is minimized by the use of a hydrophobic modified rosin emulsion sizing agent, thereby securing the proper sizing degree and effectively preventing deterioration.

In the present invention, the pH of pulp slurry was made neutral or almost neutral, and any deterioration in the resulting paper was avoided by making slightly alkaline only the surface layer of sheets by means of size press coating, etc. during the course of papermaking after the formation of such sheets. The desired effects were obtained when the surface layer was properly treated, although the paper quality is considerably affected with the conditions of light.

DETAILED DESCRIPTION OF THE INVENTION

Figure 1:
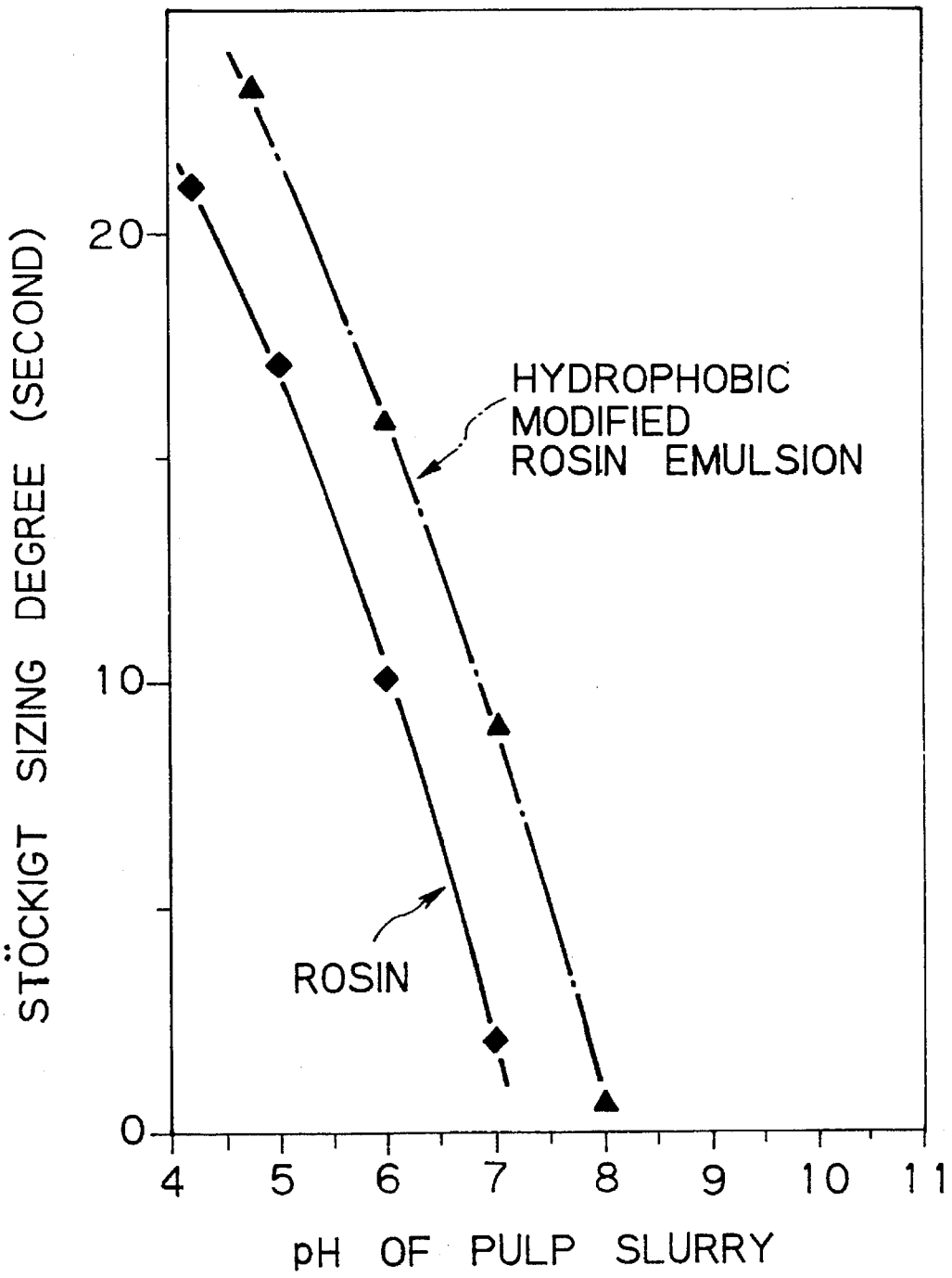
FIG. 1 is a graphic curve indicating the relationship between the pH of pulp slurry for papermaking and the sizing degree.
Figure 2:
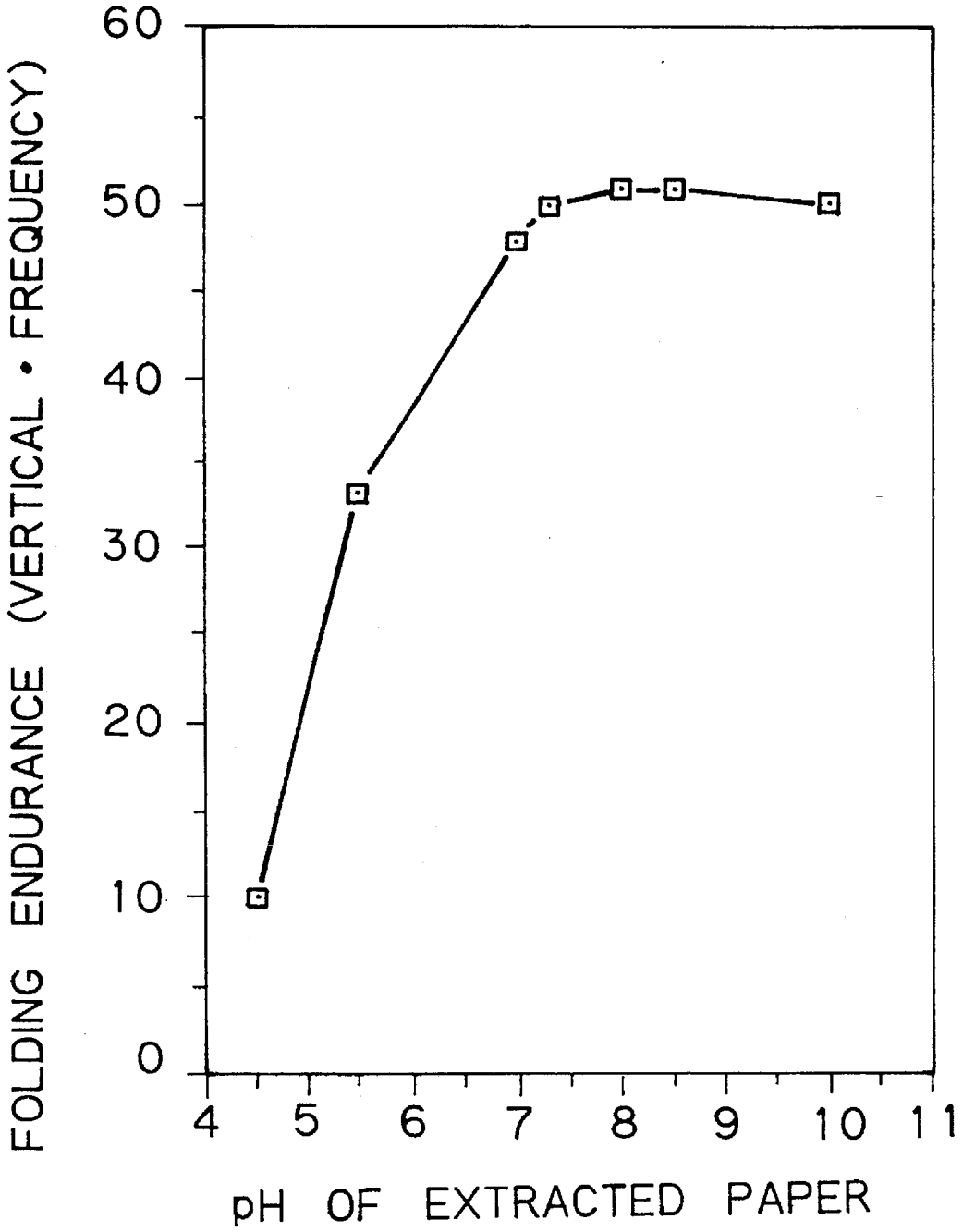
FIG. 2 is a graphic curve indicating the relationship between the pH of paper extract and the deterioration of paper.

As for the deterioration of paper, this becomes a problem in practical use when the pH of a paper extract is lower than 6 as shown in FIG. 2. As referred to in relation to FIG. 1 above, the sizing degree rapidly declines at a pH higher than 6 when a conventional rosin sizing agent is employed. As a result of investigations on the sizing agents conducted by the inventors, it was found that the sizing degree is effective at a pH of 6 or higher, and that a hydrophobic modified rosin emulsion sizing agent can be combined with aluminum sulfate in use.

Figure 3:
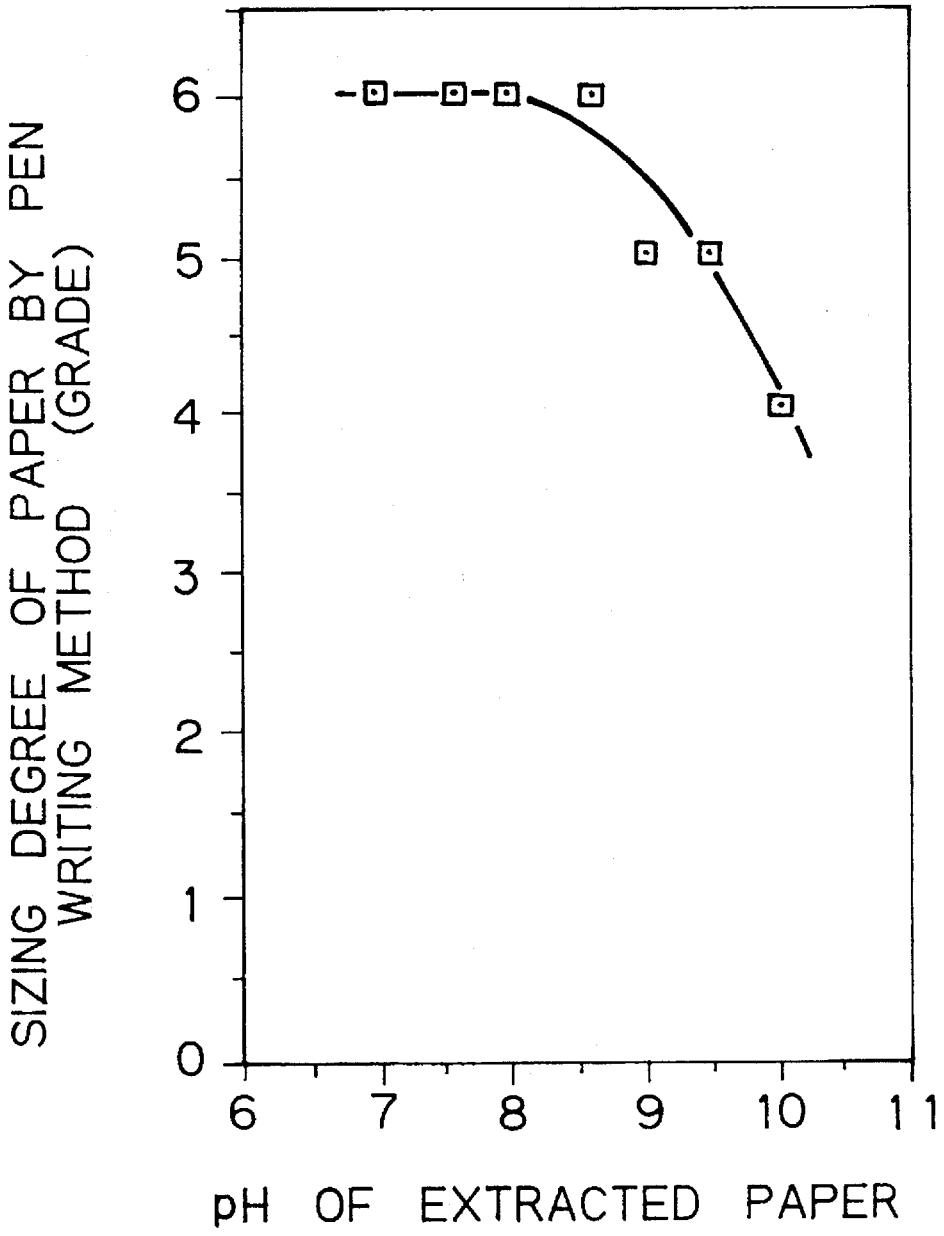
FIG. 3 is a graphic curve indicating the relationship between the pH of paper extract and the sizing degree by pen writing.

A hydrophobic modified rosin emulsion sizing agent is available from Arakawa Chemical Industries, Ltd. as a product under the trade name of "Size Pine NTS" the details of which are described in the January issue of Japanese Journal of Paper Technology published in 1992. Since the sizing degree of the hydrophobic modified rosin emulsion sizing agent also decreases at a pH of 8 or higher, it is not suitable. Thus, the pH of papermaking pulp slurry in the present invention is adjusted to 6.5–7.5 and the pH of paper extract in cold water is adjusted to 7.5–9.0, preferably 7.6–8.6, per the method of JTS P8133, by coating with an alkaline salt. When the pH of paper extract is higher than 9.0, the paper is not suitable for use since the sizing degree by pen writing (J. TAPPI standard test methods for paper pulp, No. 12) declines as shown in FIG. 3. Consequently, it was found that the papermaking method disclosed by the present invention enables one to sufficiently utilize a sizing degree and effectively avoid any deterioration in the paper.

In order to adjust the pH of papermaking pulp slurry to 6.5–7.5 by adding a water-soluble alkaline salt, a filler having a pH of 4–8 in a 10 wt % dispersion is used instead of an alkaline salt such as calcium carbonate conventionally used for neutral papermaking. Nonetheless, a mixture containing a minor amount of an alkaline salt such as calcium carbonate can be used when the pH where a filler containing calcium carbonate is dispersed in water to form 10% of a dispersion ranges between 4 and 8. However, when such a pH level exceeds 8, it is no longer possible to adjust the pH range of the present invention by adding a water-soluble alkaline salt, while the sizing degree declines even when a hydrophobic modified rosin emulsion sizing agent is used. On the other hand, when such a pH is lower than 4, the pH of pulp slurry stock decreases and the paper quality easily declines because a larger amount of a water-soluble alkaline salt is required to be added for adjustment.

The above-mentioned fillers include kaolinite, illite, titanium dioxide, plastic pigment, etc. or the mixtures of more than two species of these materials, but other fillers can also be combined for use as long as their pH levels upon being dispersed can be in the range between 4 and 8. Further, even the fillers pH of which is lower than 4 or higher than 8 can be used as well when their pH levels upon being dispersed can be adjusted to 4–8 by either surface treatment or coating with such a filler. However, from the standpoint of workability, it is desirable, in particular, to use kaolinite, illite or titanium dioxide in the present invention; the fillers ranging from 3 to 30 wt % are usually added to paper.

A hydrophobic modified rosin emulsion sizing agent to be used in the present invention may be a chemical conventionally used for papermaking; an appropriate amount may be 0.05–0.7%.

In view of the workability, aluminum sulfate is used in the present invention. An amount of aluminum sulfate to be used may be 0.1–5.0%, preferably 0.5–3.0%. Since the pH of pulp slurry in the acid papermaking using aluminum sulfate ranges from 4 to 5, it is adjusted to 6.5–7.5 by adding an water-soluble alkaline salt. An water-soluble alkaline salt includes, for example, hydroxides such as sodium hydroxide, potassium hydroxide, etc., silicates such as sodium silicate, etc. carbonate and hydrogencarbonate such as sodium carbonate, potassium carbonate and sodium hydrogencarbonate, phosphate and hydrophosphate such as sodium phosphate, disodium hydrogenphosphate, etc. An amount of an water-soluble alkaline salt to be added can be increased or decreased so that the pH of a pulp slurry ranges between 6.5 and 7.5, but an appropriate amount is 0.01–5.0%.

Although a pulp which can be used in the present invention may mainly be a chemical pulp to avoid deterioration, papers showing relatively less deterioration can be manufactured even when a deinked or mechanical pulp are used. In addition, an appropriate amount of cationic starch, a yield activator, dye, strength reinforcer, antifoaming agent, etc. can be added as an internal additive.

Furthermore, an alkaline metal salt of an acid having pKa of 5–14, preferably 6–13 in an aqueous solution at 25° C. is coated to sheet paper in the present invention. Usually, an aqueous solution of an alkaline metal salt of an acid having pKa of 5–14 exhibits weak alkaline to alkaline, thereby preventing any deterioration in the paper without degrading its sizing degree. However, when the pKa level is lower than 5, an aqueous solution of an alkaline metal salt of an acid is no longer effective in adjusting the pH level as it ranges neutral to acidic. When the pKa level is higher than 14, the sizing degree is degraded because of excessive alkalinity. Acids that can be used are not limited to inorganic or organic compounds as long as their pKa levels in an aqueous solution at 25° C. are 5–14. Alkaline metals include sodium, potassium, etc., and salts that can be used are, for example, sodium hydrocarbonate (pKa: 6.35), sodium carbonate (pKa: 10.33) disodium hydrophosphate (pKa: 7.20) and sodium phosphate (pKa: 12.35). An amount to be coated can be adjusted so that the pH of paper extract in cold water becomes 7.5–9.0, usually 0.01–5.0 g/m$^2$ and preferably 0.02–2.0 g/m$^2$. The coating methods can be selected from size press coating, air knife coating, blade coating, roll coating, bar coating, etc. but it is desirable to select size press coating from the standpoint of workability.

In addition, aqueous high molecular weight polymer, a surface sizing agent, pigment, dispersing agent, antifoamer, dye, flowability control agent, etc. can be added to an aqueous solution of an alkaline metal salt having a pKa of 5–14.

The papers provided by the present invention are used as stationary, printing paper, various kinds of base paper for coating, electrophotographic paper, etc.

As mentioned in detail above, despite the use of aluminum sulfate for the sizing method, the paper described in the present invention is excellent in sizing efficiency, prevention of deterioration and workability since the pH where a filler is dispersed in water to form 10% of a dispersion is 4–8, the pH of pulp slurry is adjusted to 6.5–7.5 and the pH of paper extracted in cold water is adjusted to 7.5–9.0 by coating an alkaline metal salt having a pKa of 5–14 in an aqueous solution at 25° C.

Deterioration in paper is successfully avoided in the present invention wherein papermaking slurry is allowed to be neutral or almost neutral and the surface layer of sheets alone is slightly alkalized by a size press, etc. during the course of papermaking following the formation of sheets. Although the paper quality is considerably affected with the conditions of light, the desired effect can be obtained when the surface layer is properly treated.

In the following Examples, the present invention is further explained in detail, however, it is to be understood that the present invention is not limited to the specific embodiments described therein. The percentages given in the Examples indicate the wt % of pulp. The pH of paper extracted in cold water is measured in accordance with JIS P8133. The pKa levels are quoted from the data disclosed in the 3rd edition of the revised Basic Chemical Handbook (compiled by Japan chemical Association and published by Maruzen in 1984).

EXAMPLE 1

A papermaking pulp slurry was prepared using 80 parts by weight of LBKP (Hard Wood Bleached Kraft Pulp. c.s.f. 390 ml), 20 parts by weight of kaolinite (pH 4.9, 10 wt % dispersion), 1.5% of aluminum sulfate, 0.3% of hydrophobic modified rosin emulsion sizing agent (Size Pine NTS manufactured by Arakawa Kagaku Kogyo K.K.) and 0.3% of sodium hydroxide. The pH of the pulp slurry thus obtained was 6.6. When this pulp slurry was used for making wood free paper of 64.0 g/m$^2$, 0.3% of an aqueous solution of sodium carbonate (pKa 10.33) was coated by a size press, when the coated amount of sodium carbonate was 0.2 g/m$^2$ and the pH of paper extract in cold water was 7.9. Table 1 shows the Stockigt sizing degree of this wood free paper, yellowness and folding endurance measured by a fadeometer after treatment. However, no problem as to the workability due to sludges of a dryer at paper making was noted.

EXAMPLE 2

A papermaking pulp slurry was prepared using 80 parts by weight of LBKP (c.s.f. 390 ml), 20 parts by weight of illite (pH 6.7, 10 wt % dispersion), 2.0% of aluminum sulfate, 0.3% of a hydrophobic modified rosin emulsion sizing agent (Size Pine NTS manufactured by Arakawa Chemical Industries Ltd.), 0.4% of sodium hydroxide and 0.3% of cationic starch. The pH of the resulting pulp slurry was 7.3. When this pulp slurry was used for papermaking of wood free paper of 55.2 g/m$^2$, 0.5% of an aqueous solution of sodium bicarbonate (pKa 6.35) was coated by means of a size press, when the coated amount of sodium bicarbonate was 0.3 g/m$^2$ and the pH of paper extract in cold water was 7.6. Table 1 shows this wood free paper evaluation of which was made as in the case of Example 1. However, no problem as to the workability due to dirt of a dryer, etc. during papermaking was noted.

COMPARATIVE EXAMPLE 1

Except for the fact that no sodium hydroxide was added and no sodium carbonate was coated thereon, wood free paper was obtained in a similar manner as in the case of Example 1. The pH of papermaking pulp slurry was 5.6 and that of paper extract in cold water was 5.5. Table 1 shows this wood free paper evaluation of which was made as in the case of Example 1.

COMPARATIVE EXAMPLE 2

The papermaking pulp slurry was prepared using 80 parts by weight of LBKP (c.s.f. 390 ml), 20 parts by weight of calcium carbonate (pH 9.4, 10 wt % dispersion) and 0.20% of a hydrophobic modified rosin emulsion sizing agent (Size Pine NTS manufactured by Arakawa Chemical Industries Ltd.). The pH of this pulp slurry was 7.9. The wood free paper was obtained using this papermaking pulp slurry. The pH of this wood free paper extract in cold water was 7.8. Table 1 shows this wood free paper evaluation of which was made as in the case of Example 1. However, there was the problem of workability due to dirt, etc. of a dryer during papermaking.

TABLE 1

| | Stockigt sizing degree *1 (second) | Yellow-ness *2 (%) | Folding Endurance *3 (fre.) | Work-ability *4 |
|---|---|---|---|---|
| Ex. 1 | 17 | 2.7 | 50 | 0 |
| Ex. 2 | 18 | 2.5 | 54 | 0 |
| Comp. Ex. 1 | 17 | 7.3 | 30 | 0 |
| Comp. Ex. 2 | 15 | 2.2 | 48 | x |

*1 is quoted from JIS P8122.
*2 indicates the difference of yellowness before and after the treatment by a fadeometer for 50 hours.
*3 is quoted from JIS P8115.
*4 marks zero for no problem due to dirt of a dryer and x for the existence of a problem.

What is claimed is:

1. A permanent paper which employs as a stock pulp slurry containing at least one kind of filler, and aluminum sulfate, a hydrophobic modified rosin emulsion sizing agent and a water-soluble alkaline salt, wherein the pH where said filer is dispersed in water to form 10% of a dispersion is 4–8, the pH of said pulp slurry is controlled within 6.5–7.5 and an alkaline metal salt of an acid having a pka of 5–14 at a 25° C. aqueous solution is coated onto said paper in an amount of 0.01–5.0 g/m$^2$ and the pH of an extract of the coated paper in cold water is 7.5–9.0.

2. A permanent paper in accordance with claim 1 which is used as electrophotographic transfer paper.

3. A permanent paper in accordance with claim 1 wherein said filler is selected from the group consisting of kaolinite, illite, titanium dioxide, plastic pigment and a mixture thereof.

4. A permanent paper in accordance with claim 1 wherein said pH of paper extract in cold water is 7.6–8.6.

5. A permanent paper in accordance with claim 1 wherein said coating is applied by a size press.

* * * * *